United States Patent [19]

Courtois et al.

[11] Patent Number: 4,500,227

[45] Date of Patent: Feb. 19, 1985

[54] PROCESS AND GEOLOGICAL INSTALLATION FOR THE REMOVAL OF RADIOACTIVE WASTE

[75] Inventors: Guy Courtois, Paris; Claude Jaquen, Guyancourt, both of France

[73] Assignee: Commissariat a l'Energie Atomique, Paris, France

[21] Appl. No.: 491,395

[22] Filed: May 4, 1983

[30] Foreign Application Priority Data

May 5, 1982 [FR] France ..... 82 07786

[51] Int. Cl.[3] ..... E21F 17/16; G21F 9/24

[52] U.S. Cl. ..... 405/128; 252/633; 405/53

[58] Field of Search ..... 405/128, 129, 52–59; 166/305 D; 252/629, 628, 633

[56] References Cited

U.S. PATENT DOCUMENTS

| | | | |
|---|---|---|---|
| 2,788,637 | 4/1957 | Benz | 405/53 X |
| 4,020,004 | 4/1977 | Schulz et al. | 252/629 |
| 4,040,480 | 8/1977 | Richards | 166/305 D |
| 4,045,963 | 9/1977 | Hansson et al. | 405/53 |
| 4,189,254 | 2/1980 | Akesson | 405/128 |
| 4,192,629 | 3/1980 | Hallenius et al. | 405/128 |
| 4,230,597 | 10/1980 | Bustard et al. | 252/628 |
| 4,269,728 | 5/1981 | Schweitzer et al. | 252/633 |
| 4,320,028 | 3/1982 | Leuchtag | 405/128 X |
| 4,326,820 | 4/1982 | Verpmann et al. | 405/128 |
| 4,363,563 | 12/1982 | Hallenius et al. | 405/55 |

FOREIGN PATENT DOCUMENTS

| | | |
|---|---|---|
| 2755554 | 6/1978 | Fed. Rep. of Germany . |
| 2411473 | 12/1978 | France . |

*Primary Examiner*—Dennis L. Taylor

*Attorney, Agent, or Firm*—Kerkam, Stowell, Kondracki & Clarke

[57] ABSTRACT

It comprises in combination a series of vertical shafts for passing the waste down into the subsoil, and for ventilation purposes, linking the ground surface to the very deep storage location; a first upper plane of horizontal, parallel and equidistant tunnels, provided with means for moving the waste; and a second lower plane of horizontal, parallel and equidistant tunnels inclined by an angle $\alpha$ relative to the common direction of the tunnels of the first upper plane.

12 Claims, 10 Drawing Figures

PROCESS AND GEOLOGICAL INSTALLATION FOR THE REMOVAL OF RADIOACTIVE WASTE

BACKGROUND OF THE INVENTION

The present invention relates in general terms to the procedures used in storing radioactive materials obtained from spent fuel elements following their discharge from a nuclear reactor.

Fissile materials which have been used in a nuclear reactor, such as e.g. a pressurized light water-cooled, uranium-enriched reactor, are depleted in $U_{235}$ and correlatively enriched in plutonium and at the same time waste is produced. As the latter is fissile and can in turn be used in fast neutron reactors, reprocessing operations are frequently carried out on such spent fuel elements and essentially permit the separation of uranium depleted in isotope 235 and the plutonium formed, as well as the conditioning of the waste in a safe form. Following a reprocessing operation, the residual unusable products and which contain a large proportion of highly radioactive materials then undergo vitrification.

Two major problems have to be taken into consideration in connection with this storage process. Firstly and obviously, the thus conditioned waste is highly radioactive and constitutes a fatal hazard for all living organisms, from which it must be separated by biological protection means. Secondly, and this is often not taken into consideration with all the attention which should be taken, the radioactive disintegration reactions taking place therein, release energy in the form of heat. It must also be borne in mind that the decay periods of these radioactive materials are often very long and can extend e.g. to between 30 and 30,000 years.

To illustrate what has been stated hereinbefore, the following tables 1 and 2 give respectively for fission products and actinides, the masses and powers of the radioactive nuclei obtained on the basis of the reprocessing of one tonne of uranium contained in the fuel elements of a light water nuclear reactor, whose reprocessing took place 3 years after discharging the fuel.

FISSION PRODUCTS

TABLE I

| Fission products | Period (years) | | After reprocessing for t = 3 years Weight (g) | Power (Watts) |
|---|---|---|---|---|
| (Ca + Ba) 137 | 30 | Cs | 1155 | 162 |
| | | Ba | 68 | 367 |
| (Sr + Y) 90 | 28 | Sr | 442 | 93.6 |
| | | Y | 508 | 411 |
| Eu 154 | 16 | | 44.7 | 56.2 |
| Sm 151 | 87 | | 41.4 | 2 |
| Tc 99 | $2.16\ 10^5$ | | 835 | 0.009 |

ACTINIDES

TABLE 2

| Emitters | Period (years) | After processing for t = 3 years Weight (g) | Emitted power (W) |
|---|---|---|---|
| 244 Cm | 17.6 | 27.8 | 78.8 |
| 241 Am | 458 | 191 | 20.7 |
| 243 Am | 7650 | 90.4 | 0.56 |
| residual 239 Pu | 24,360 | 13.5 | 0.03 |

In order to illustrate the consequences of the above data, it is pointed out that the thus vitrified radioactive waste is stored in France in the form of a compact cylindrical mass having a volume of 220 liters in a metal container having a wall thickness of 5 mm, a diameter of 430 mm and a height of 1660 mm. Such containers spontaneously heat to elevated temperatures. In order to ensure satisfactory storage with an adequate safety limit, it has been decided not to exceed 200° C. in the container surface and 450° C. in the glass core on the container axis. Such a per se known container is shown for information purposes in FIG. 1.

The simplest idea for disposing of such vitrified waste is that of burying it in the ground. Unfortunately, theory and practice show that such a confinement, without special precautions, in subterranean tunnels or chambers is impossible as a result of the temperatures which could be assumed by the thus stored mass and which would be adequate to bring about serious cracking or subsidence of the ground, accompanied by the partial destruction of certain of these glass containers, which could lead to extremely dangerous radioactive products spreading into the environment.

Therefore, such vitrified waste is generally stored in three successive periods, namely:

1. A provisional or interim storage of 4 to 5 years in concrete chambers in the vicinity of the surface of the ground and traversed by forced cooling air in order to remove calories and limit the overall temperature to a maximum of about 200° C. Small capacity metal shafts enable the storage in an installation of this type of 3000 to 4000 highly active glass containers.

2. After this first radioactive decay period, there is a long-term interim storage, still in the vicinity of the surface, at a depth of 6 to 50 mm in concrete chambers constructed by digging and provided with a free or forced cooling system.

3. A final storage very deep in the ground of said same glass containers, when their activity state has decreased sufficiently to ensure that the mass then finally placed in the ground does not heat the receiving rock to beyond 100° to 150° C., as a function of its type. The final deep storage installations (e.g. approximately 500 to 1000 mm) are then finally sealed by geochemical barriers using a material ensuring both the mechanical continuity of the geological massif and the thermal continuity between the glass containers and the rock, in order to permit the dissipation of residual energy which will be emitted for several thousand years.

The need to separate the aforementioned stages 2 and 3 formed by the interim long-term storage and the final storage in the ground, leads to a major complication consisting of the raising to the surface and the transfer to another site of highly active glass containers. This obviously increases the risks of contamination and consequently the danger linked with the problem of removing such radioactive waste.

BRIEF SUMMARY OF THE INVENTION

The present invention relates to a geological storage installation permitting, as a result of relatively simple means, the realisation of the two aforementioned storage periods in a successive manner on the same site.

The invention therefore relates to a process for the removal of in particular vitrified radioactive waste, wherein on the same geological site and in a successive manner in time, there is a first interim storage with air ventilation by natural convection and then, after stopping the ventilation and sealing the site with a geochemical barrier, a final storage which ensures the complete decay of the radioactivity of said waste.

Thus, the process according to the invention, consists of carrying out the interim and final storage operations in a single geological installation at an adequate depth, but which can still be ventilated by the natural convection of fresh air from the ground surface and moved solely by the thermal energy released by the radioactive waste buried in the ground. When the radioactive decay has reached the desired level, there is no longer any risk involved in carrying out the final storage in situ, so that the site is completely and definitively sealed, obviously after stopping the aforementioned ventilation.

The invention also relates to a geological installation making it possible to perform the aforementioned process and which, in the ground, comprises the following in combination:

(a) a storage site located at a predetermined depth below ground level;

(b) a plurality of vertical access shafts extending between the surface of the ground and the storage site for providing access for the waste and for ventilation purposes;

(c) a first upper plurality of tunnels all lying in a first horizontal plane substantially equidistant from each other and parallel to a first reference line representative of the common direction of said first plurality of tunnels, the first reference line lying in the first horizontal plane and also lying in a first vertical plane;

(d) means within said first plurality of tunnels for moving the waste;

(e) a second lower plurality of tunnels all lying in a second horizontal plane substantially equidistant from each other and parallel to a second reference line representative of the common direction of said second plurality of tunnels, the second reference line lying in the second horizontal plane and also lying in a second vertical plane;

(f) the first vertical plane of the first reference line representative of the common direction of said first plurality of tunnels intersecting the second vertical plane of the second reference line representative of the common direction of the second plurality of tunnels at an angle $\alpha$;

(g) a plurality of vertical storage shafts for storing the waste and linking, in accordance with a regular geometrical grid, the tunnels of the first plurality and the tunnels of the second plurality, the upper part of each storage shaft communicating with a tunnel of the first plurality and the lower part of each storage shaft communicating with a lateral recess connected to one of the tunnels of the second plurality; and (h) at least one of the vertical access shafts supplying the tunnels of the second plurality with fresh air from the ground surface, and at least one other of said vertical access shafts evacuating hot air from the tunnels of the second plurality to the ground surface, the cooling air circulation taking place in hair-pin like manner in an upward-downward path in the vertical storage shafts connecting the two pluralities of tunnels during interim storage by the convective effect of heat released by the stored waste.

The distribution of the radioactive waste in the vertical storage shafts connecting the tunnels of the first plurality or plane and those of the second plurality or plane make it possible to solve in a simple and practical manner the essential problems of this type of storage. Thus, the vertical shafts giving access from the ground surface to the installation are used in some cases for lowering the radioactive waste to a great depth and partly for ensuring air ventilation by natural convection in the installation. The tunnels of the upper plane are provided with means for moving the waste, such as e.g. trolleys or locomotives on rails. The tunnels of the second lower plane are used for supplying fresh air from the surface and for evacuating the hot air which has circulated in the installation. The fact that the common direction of the tunnels of the second or lower plane is angled by an angle with respect $\alpha$ to the common direction of the tunnels of the first or upper plane, makes it possible to position vertical storage shafts between the axis of the tunnels of the first plane and lateral recesses, adjacent to the tunnels of the second plane, in which a support resting on the ground surface ensuring the seating and stability of the vitrified radioactive waste containers stacked in said vertical storage shafts from the upper tunnels of the first plane. These vertical shafts in which heat is given off due to the storage of the waste, are also traversed in hairpin-like manner in the upward - downward direction by the flow of natural convection ventilation air. The angling of the directions of the tunnels of the two planes relative to one another brings about a clear advantage. Even if it had been possible to provide for the vertical shafts to issue into the axis of the tunnels of the upper plane for the loading of said shafts, it was not conceivable that said same storage shafts could issue directly into the axis of the tunnels of the second lower plane and consequently it would have been necessary to provide a significant swelling of each of these tunnels at the lower arrival point of each storage shaft, which would have made construction much more difficult. In the installation according to the invention, the arrival point at the second level of the vertical storage shafts is positioned laterally and in the immediate vicinity of the tunnels of the second plane, which makes it possible to install them in an identical lateral recess constructed in accordance with the same pattern.

According to the invention, the angle $\alpha$ of the direction of the tunnels of the second plane with respect to the direction of the tunnels of the first plane is preferably equal to either 30° or 45°, the regular geometrical grid of the vertical storage shafts between the two planes of tunnels having either a hexagonal mesh or a square mesh arrangement.

In practical terms, the entry of fresh air and the discharge of hot air with respect to the tunnels of the second plane takes place by means of a circle or belt of two peripheral tunnels, passing round the tunnels of the second plane and communicating therewith.

According to another feature of the invention, within each vertical storage shaft, the radioactive waste is distributed into tubes occupying the periphery of the shaft and traversed by ascending fresh air, the hot air redescending into an empty central tube, whilst the base of each peripheral tube can have a drop damping device and the group of tubes rests on a concrete filled, cast iron base support, positioned in the centre of a lateral recess.

According to another feature of the geological installation according to the invention, the vertical storage shafts are sealed, when they issue into the tunnels of the first plane, by a metal plate or plug ensuring the protection of the personnel against radiation, without preventing the movement of vehicles.

As a function of the nature of the rock, the first upper plane of the tunnels can be located at between 300 and 1000 meters and the vertical distance separating them from the second lower plane of tunnels can be approximately 20 to 40 meters and preferably 25 to 30 meters, which makes it possible to superimpose 10 to 15 layers of in each case 6 nitrified containers with a height of in each case approximately 1.85 m in the aforementioned tubes.

BRIEF DESCRIPTION OF THE DRAWINGS

The invention is described in greater detail hereinafter relative to non-limitative embodiments and the attached drawings, wherein shows.

FIGS. *7a* to *7d* the different possible configurations of the slope of the direction of the upper and lower tunnels with respect to one another, related to the different configurations of the geometrical grid of vertical shafts resulting therefrom.

DETAILED DESCRIPTION OF THE PREFERRED EMBODIMENTS

Figure 1:
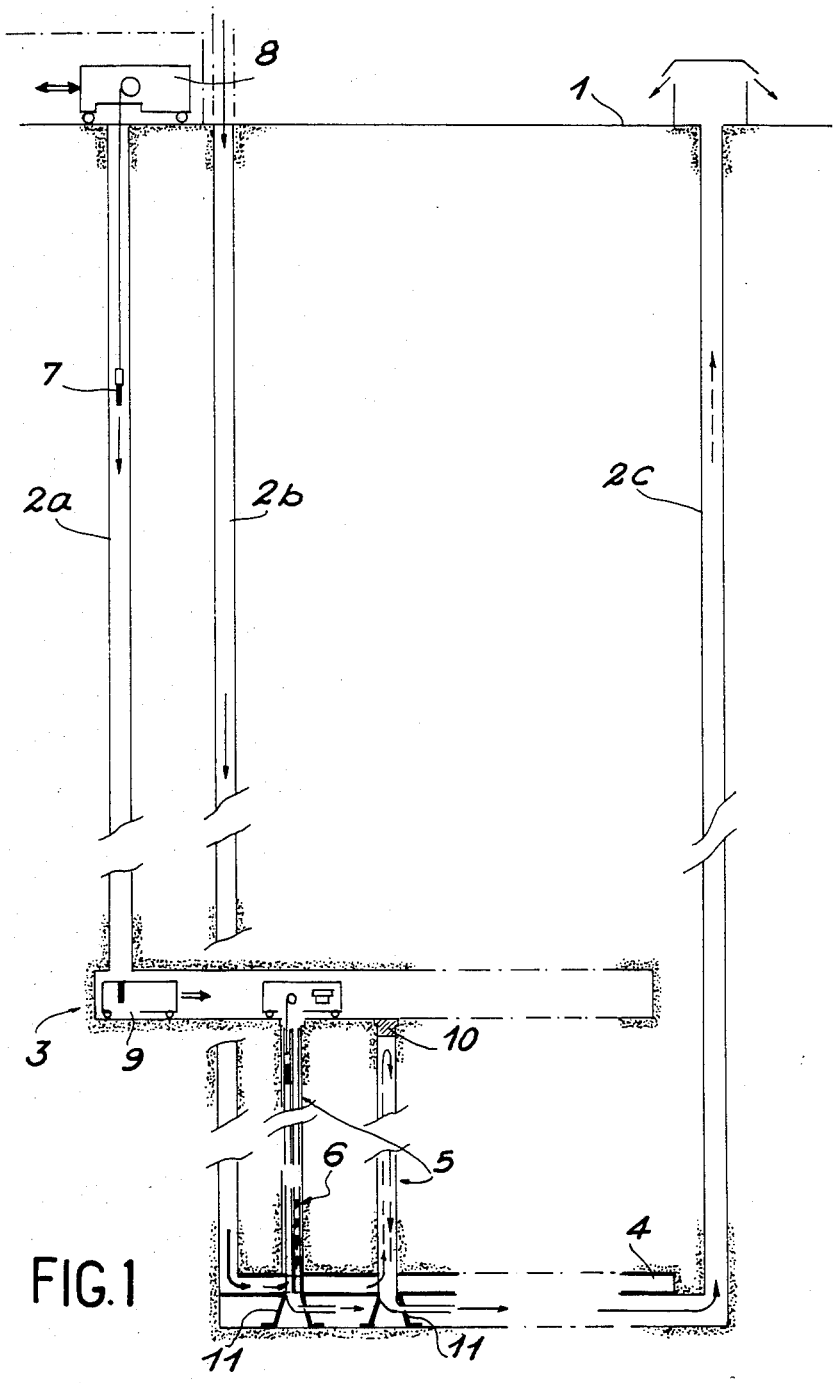
FIG. 1 a sectional elevation of the general installation in the ground of a geological installation according to the invention.

FIG. 1 shows the access shafts *2a, 2b, 2c,* dug out at a considerable depth below the ground level 1.

The common direction of the horizontal tunnels 3 of the first upper plane and the common direction of the horizontal tunnels 4 of the second lower plane, for ease of understanding the drawing, are drawn parallel to each other. However, according to the invention, these common directions are in fact angled by an angle relative to each other. Between the planes of tunnels 3 and 4 extend the vertical storage shafts 5, in which are stored the vitrified radioactive waste containers, whereof only a few 6, are diagrammatically shown in FIG. 1.

The access shaft *2a* is used for lowering to tunnels 3, the drums such as 7, from a loading machine 8, located on the surface and which is protected and moves on wheels. In tunnel 3, another transfer machine 9 takes up the drums 7, moves them along tunnel 3 and introduces them into the left-hand vertical shaft 5, after having removed therefrom the metal plate or plug 10. At the bottom of each vertical storage shaft 5, it is also possible to see the base support 11 supporting the line of drums 6 introduced into each shaft.

The natural convection ventilation of the installation of FIG. 1 takes place in the manner indicated by the arrow therein, i.e. tube *2b* is used for sucking fresh air from the ground surface 1 and this then travels along tunnels 4 and then, from there, in hairpin-like manner in a rising and falling path in each of the vertical shafts 5. It is finally removed in the form of hot air by pipes axial to each vertical storage shaft 5 and is raised to the surface by the ventilation shaft *2c*. According to the invention, it is the chimney effect resulting from the presence in shafts 5 of radioactive waste giving off a large amount of heat, which permits this coding air circulation by natural convection in the present installation.

To give rough ideas of the dimensions of the installation of FIG. 1, the first upper plane 3 of tunnels is located at a depth of 500 meters and the second plane 4 of tunnels 30 meters lower, i.e. 530 meters from the ground surface 1.

Figure 2:
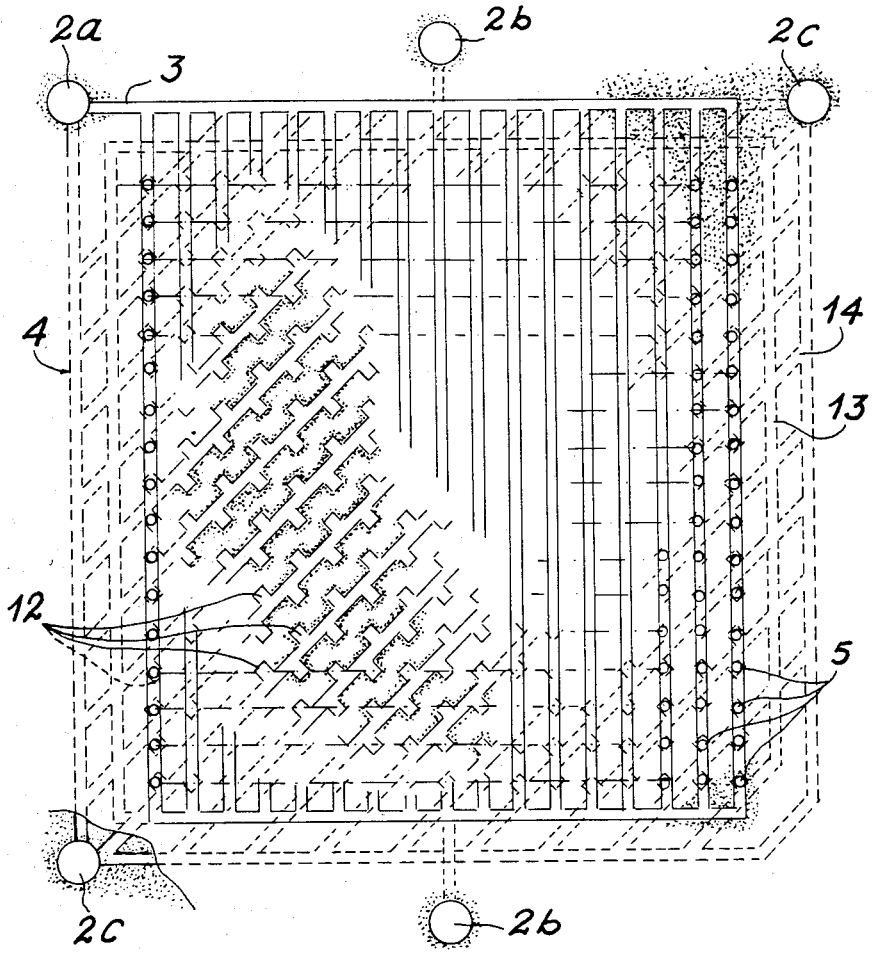
FIG. 2 a diagrammatic plan view of a storage system comprising an upper tunnel and a lower tunnel, illustrating the location of the vertical storage shafts between the two tunnels.

FIG. 2 diagrammatically shows a plan view of the two levels of tunnels 3 and 4 in the installation of FIG. 1. Tunnels 3 are shown in continuous lines and tunnels 4 in broken lines, to prevent any confusion. It is also possible to see the shafts *2a* for the supply of cooling air *2b* and the discharge of hot air *2c*. The total ground plan of the installation is 500×500 m, i.e. each of the tunnels 3 has a length of 500 m and there are 17 of these, with a distance of 25 m between them. In the embodiment of FIG. 2, the common direction of the tunnels 4 of the lower plane is angled by 45° with respect to the common direction of the tunnels 3 of the upper plane and the different recesses 12 containing the vertical storage shafts 5 are positioned vertically of the tunnels of the first horizontal plane 3, so as to permit the easy loading of shafts 5. In all, there are 149 shafts 5 over the entire surface area, but only some of these are shown. They have a diameter of 3.2 m. The tunnels of levels 3 and 4 have a circular profile, which is slightly flattened towards the bottom and a diameter of 5 m. The access or evacuation shafts 2 have a diameter of 8 m. According to the invention, two peripheral tunnels 13, 14 pass round the oblique tunnels of the lower level 4 and serve, in the manner to be described hereinafter, to facilitate the distribution of the cooling air coming from the surface and the hot air to be evacuated to the surface, after it has passed through the vertical shafts 5.

In the embodiment of FIG. 2, the 149 vertical storage shafts 5 are positioned at the apex of a square mesh grid.

Figure 3:
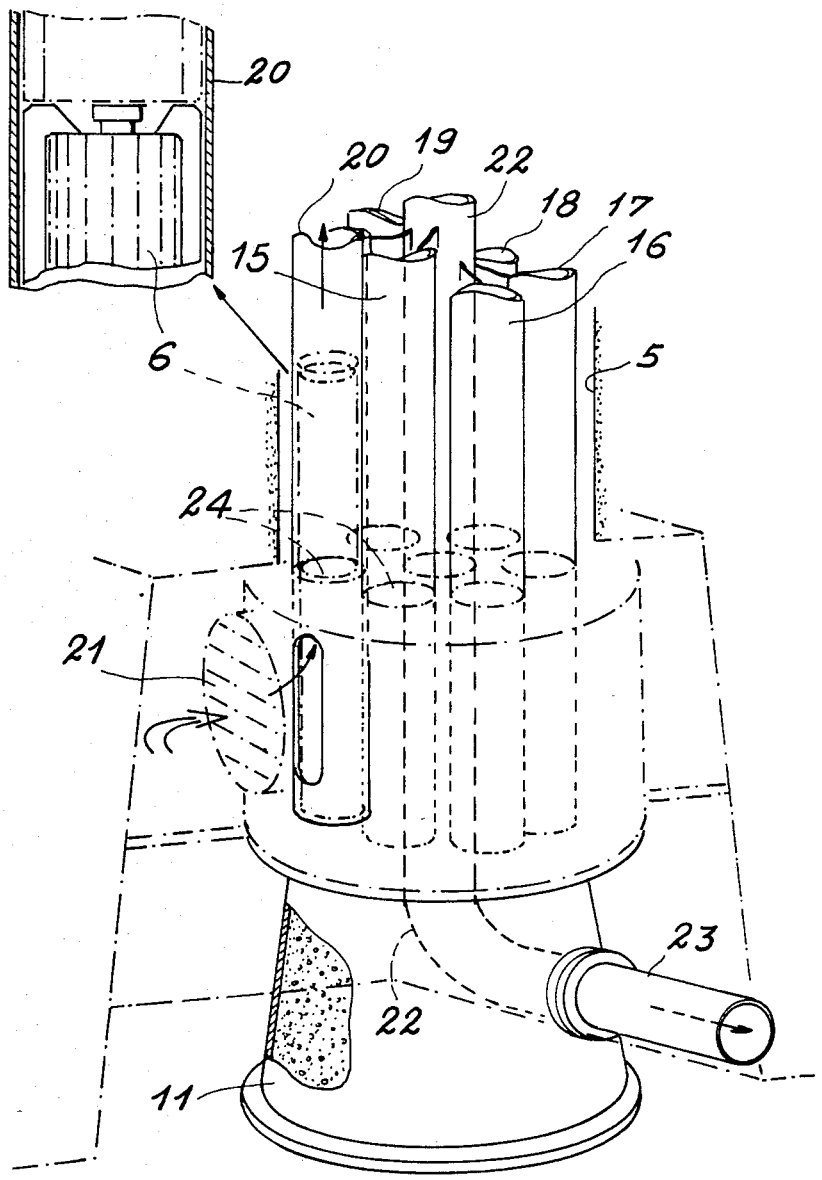
FIG. 3 a constructional detail of a lateral recess in which it is possible to see the base support for 6 tubes housing vitrified containers.

FIG. 3 shows the details of the recesses 12 used as a support for a line of vitrified radioactive containers piled up in a vertical shaft, such as 5. In recess 12, it is possible to see a concrete-filled, cast iron base support 11, on which rests 6 tubes 15, 16, 17, 18, 19 and 20, in the bottom of which are positioned the not shown anti-drop means, serving as a support for the vitrified waste containers arranged in superimposed manner therein. Each tube, such as 20, is provided with a cold air supply pipe 21, having a baffle permitting the passage of said air, whilst ensuring the biological protection with respect to the radioactive products contained in the tube 20. The 6 stored product housing tubes 15 to 20 are consequently traversed by an upward fresh air flow, which permanently plays on the periphery of the vitrified containers stacked in each tube. An empty central tube 22 is used for the return of the hot air from the upper part of the vertical shaft 5 to the hot air discharge pipe 23, which is connected to the discharge tunnel 14 of FIG. 2. A separating floor 24, shown in exploded form, in order to make it possible to see support 11, separates the upper part of the recess in which circulates the cold air from the surface, from the lower part in which is located the hot air pipe 23.

In the present embodiment, the height of shaft 5 is 30 mm and the tubes 15 to 20 contain 10 to 15 layers of 6 vitrified radioactive waste containers, each having a height of approximately 1.85 m.

Figure 4:
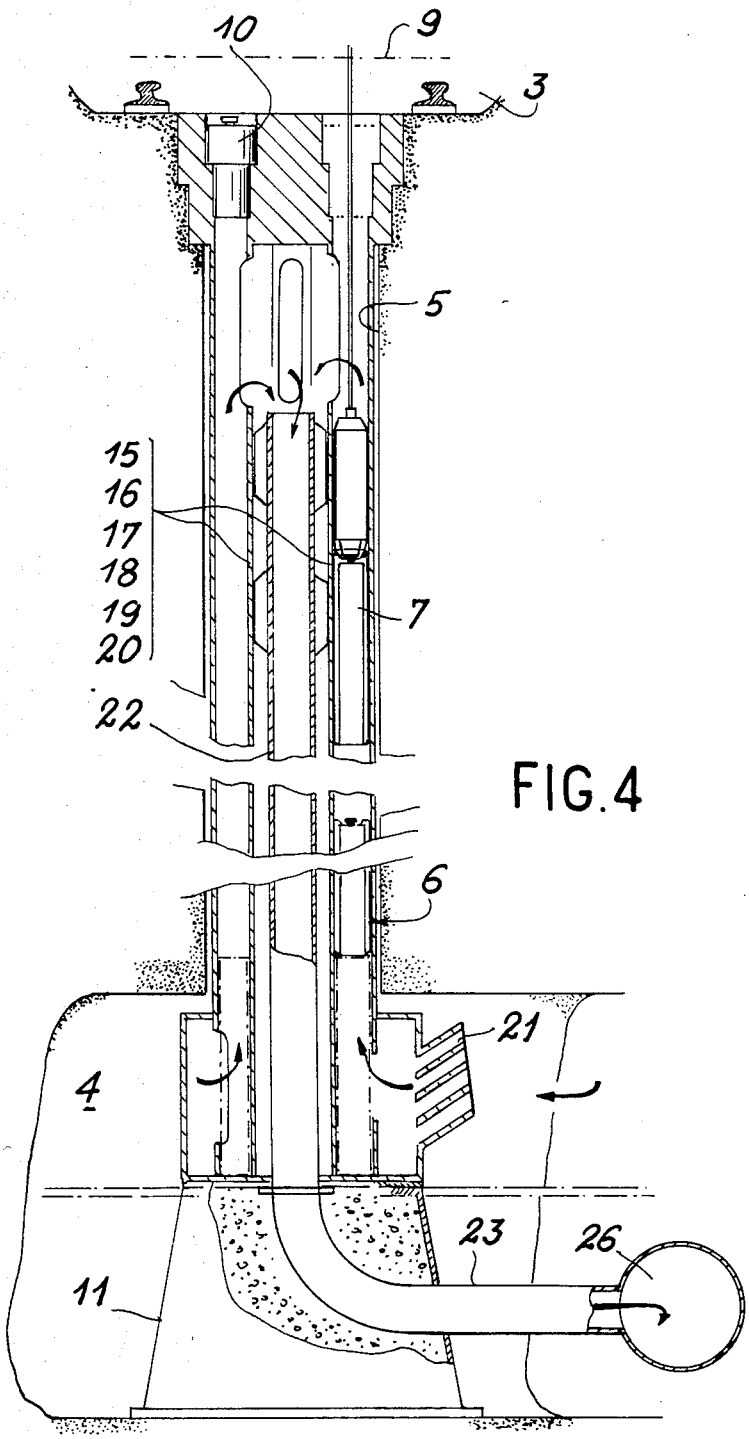
FIG. 4 an axial section of FIG. 3, showing the location of the tubes and the containers located therein, as well as the air flow direction.

FIG. 4 shows in axial section along the axis of shaft 5 of FIG. 3, tubes 17, 22 and 20, provided with their anti-drop damping means 24. The arrows show the upward cool air circulation direction in peripheral tubes 17 and 20 and the downward hot air circulation direction in the empty central tube 22.

Figure 5:
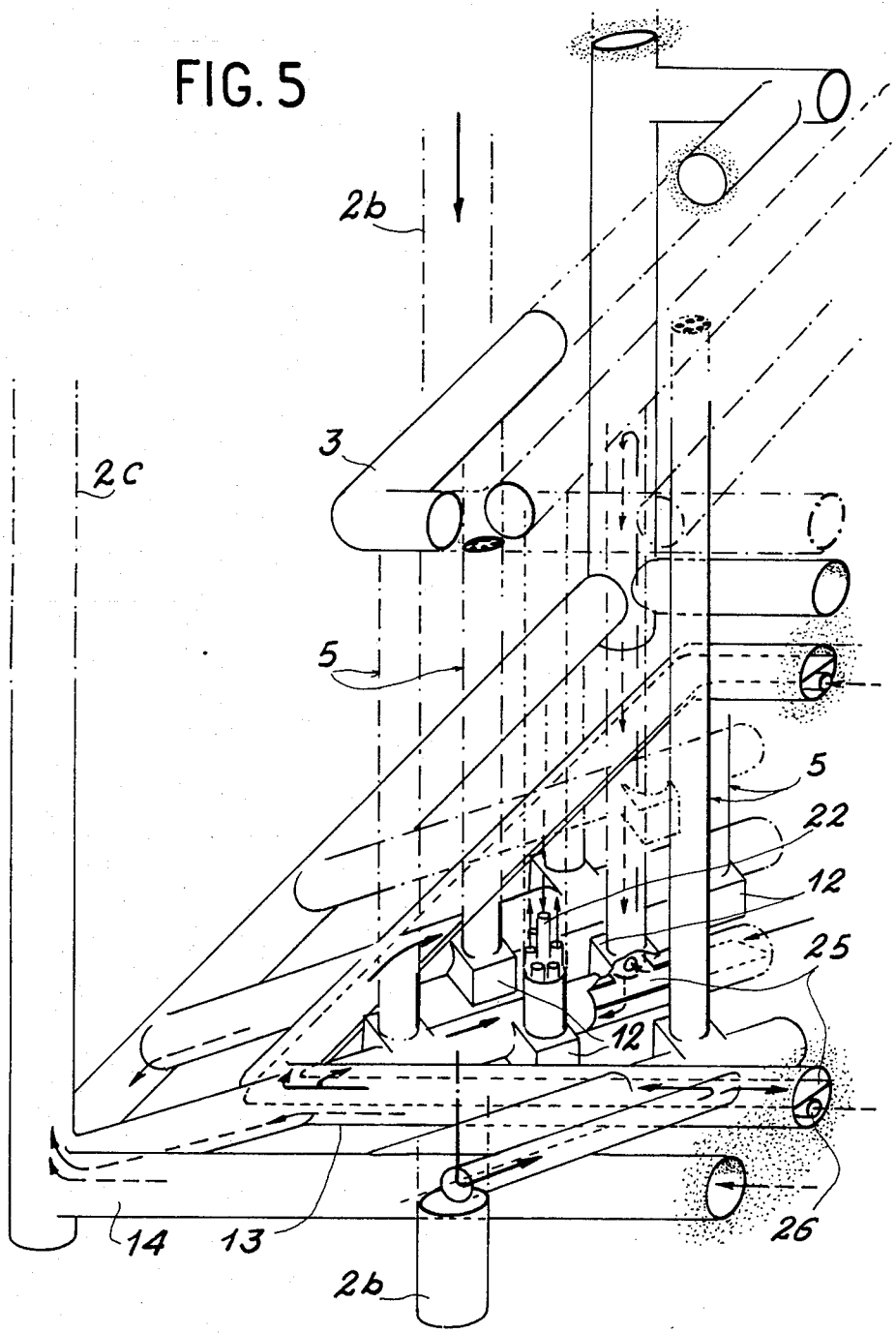
FIG. 5 a perspective view of part of the installation showing the two planes of upper and lower tunnels and their connections with the vertical storage shafts on the one hand and the cold and hot air access shafts on the other.

FIG. 5 is a perspective view of one of the angles of the installation of vertical shafts 5 between the tunnels of the first upper plane 3 and the tunnels of the second lower plane 4. It is possible to see the hot air discharge shaft 2*c* and the cold supply shaft 2*b*, as well as the two peripheral tunnels 13, 14 used for the distribution of the fresh air arriving from the surface (continuous lines) and the hot air discharged to the surface (broken lines) at the second level of tunnels 4. It is also possible to see a certain number of recesses 12, as well as vertical shafts 5 and the exploded view makes it possible to see the 6 peripheral storage tubes and the central hot air return tube. In the ducts 4 of the second plane tunnel and in duct 13, a subdivision into two compartments is brought about by a median plate 25, which separates the upper part of the duct in which the fresh air circulated freely from the lower part in which a second duct 26 is used for carrying the hot air. This plate 25 corresponds to the floor 24 of FIG. 3 for separating recesses 12.

The installation described with reference to the first 5 drawings is suitable for receiving radioactive waste corresponding to the reprocessing by a plant treating 1600 tonnes of fuel annually and which is operated for 30 years. Thus, it is possible to store in a definitive manner approximately 24,000 220 liter drums of vitrified radioactive waste, without the temperature exceeding the critical value of 100° C. on the surrounding rock. It is pointed out that the temperature in the peripheral hot air discharge tunnel 14 does not exceed 90° C. in permanent operation.

Figure 6:
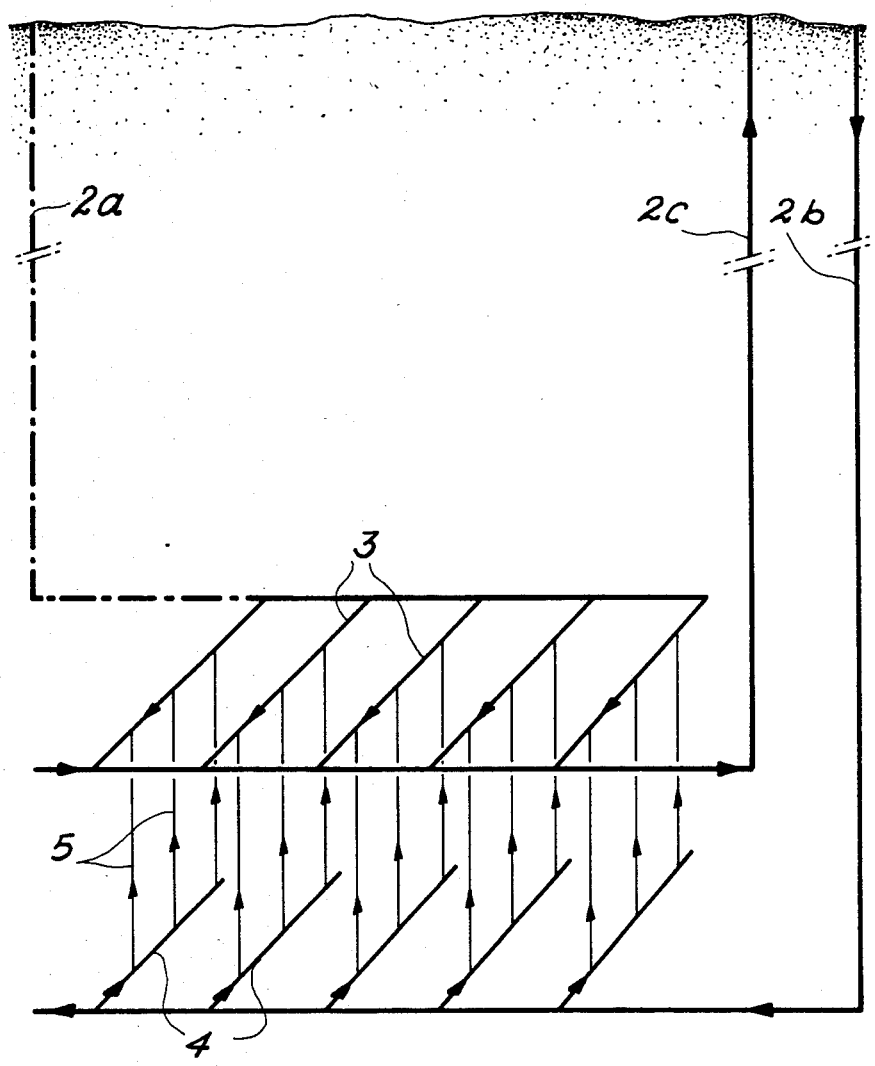
FIG. 6 a possible variant of the natural convection ventilation air circuit in the installation according to the invention.

FIG. 6 shows in diagrammatic, simplified manner, a variant of the circulation by natural convection of air in an installation of the same type as in the previous drawings. It is once again possible to see the fresh air access shafts and the hot air discharge shaft 2*c*, in conjuction with the tunnels 3 of the first plane and the tunnels 4 of the second lower plane. As in FIG. 1, for reasons of simplicity, the angle between the tunnels of the respective common directions of different stages is not shown. The difference compared with the previously described embodiment is that in this case the fresh air coming from the surface via duct 2*b* is directly injected into the tunnels of level 4 and rises in one direction in all shafts 5 to issue into the various tunnels of the first plane and is discharged by duct 2*c* from the first upper plane 3. Thus, in this variant, there is no natural air circulation in accordance with a hairpin-like path in the vertical storage shafts 5.

FIGS. 7*a*, 7*b*, 7*c* and 7*d* show several possible examples in connection with the installation of the vertical storage shafts 5 in a regular grid system. The continuous lines represent the tunnels of the first plane 3, as well as in broken lines the tunnels of the second plane 4, which are angled with respect to the tunnels of the first plane 3 by an angle $\alpha$. These drawings show that there are numerous possible configurations for the arrangement of the vertical storage shafts 5 and correspond to the angle $\alpha$ of the common direction of the tunnels of plane 3 with respect to the common direction of the tunnels of plane 4.

On taking as parameters the minimum centre-to-centre distance a between two tunnels of plane 3 and the minimum centre-to-centre distance b between two shafts 5, it must firstly be borne in mind that these two parameters are limits imposed for a between tunnels for mechanical strength reasons, and for b between storage shafts 5 by thermal reasons, because the heating of the rock must be limited to approximately 100° to 150° C., as a function of the nature thereof.

Figure 7A:
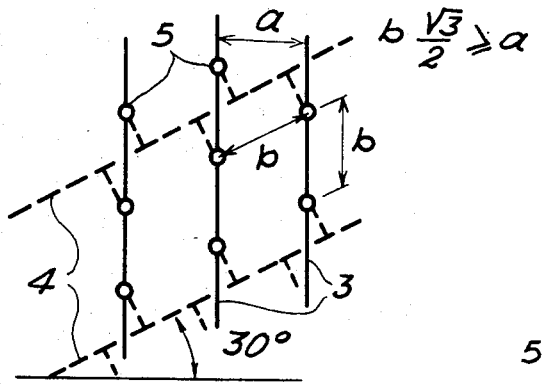
Figure 7B:
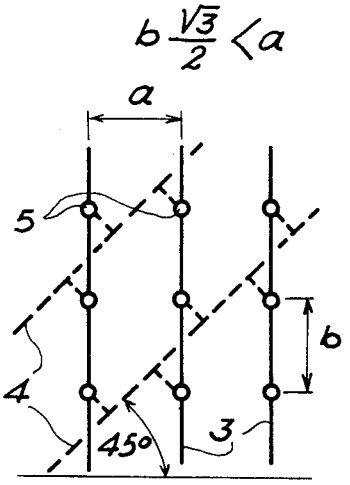

As a function of the different hypotheses which may occur and in particular the physical characteristics of the geological medium, consideration must be given to three cases I, II and III. I. In the case of FIGS. 7*a* and 7*b*, it is assumed that b>a. Thus, two cases must be examined.

(1)

$$b\frac{\sqrt{3}}{2} \geqq a$$

in this case the optimum grid is a hexagonal grid of meshes b, in the manner shown in FIG. 7*a*, the centre-to-centre distance between tunnels 3 then being $$a = b\frac{\sqrt{3}}{2},$$

which leads to a hexagonal mesh and to angle $\alpha$ of the common direction tunnels 4 with respect to the common direction to tunnels 3 equal to 30°.

(2)

$$b\frac{\sqrt{3}}{2} < a,$$

i.e. cf FIG. 7*b*, it being then of interest to provide a square mesh grid of side length b, the angle of the common direction of tunnels 4 with respect to the common direction of tunnels 3 being 45° C.

II. If b=a, i.e. the case of FIGS. 1 to 6, and the optimum is then the square mesh and the angle $\alpha$ between the respective common directions of the tunnels of the two planes is 45°, with a mesh side equal to a.

Figure 7C:
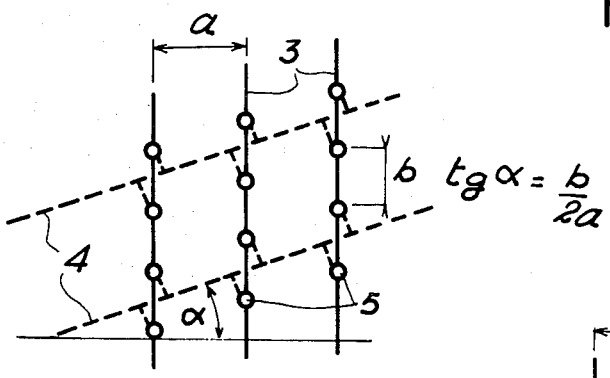
Figure 7D:
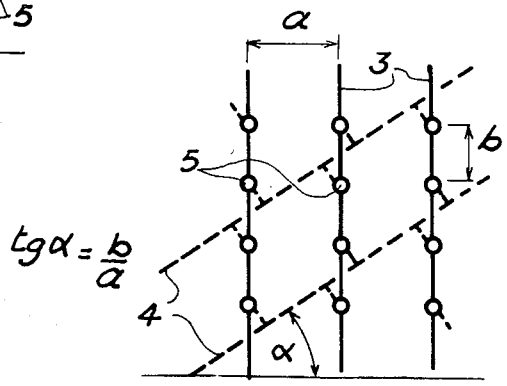

III. b<a, i.e. the case of FIGS. 7*c* and 7*d*, corresponding in each case to a different construction, depending on whether angle $\alpha$ is chosen so as to give $tg\alpha = b/2a$ (FIG. 7*c*) or $tg\alpha = b/a$ (FIG. 7*d*). In the first case (FIG. 7*c*), the mesh of the storage channels 5 is a parallelogram mesh and in the second case (FIG. 7*d*), it is a rectangular mesh.

In the case where b<a, it is of interest to have a centre-to-centre distance between the upper shafts equal to a, whilst also producing a square mesh grid of side length a, the angle $\alpha$ still being 45°, in order to simplify construction and the thermocalculation possibilities of the configuration.

The above points are only given for information to demonstrate the basic nature of the invention, according to which there is an angle $\alpha$ between the respective common directions of the tunnels of the first and second planes and in practice there are numerous ways in which the storage shafts 5 can be installed without passing beyond the scope of the invention. However, it is clear from the above description that the most appropriate values for angle $\alpha$ are 30° to 45°, whilst a hexagonal or square mesh is the most suitable for the regular geometrical grid of the vertical storage shafts.

The receiving rock from which the tunnels of the present installation are hollowed out can be of a very varied nature, but particular interest is attached to granite, clay, salt or volcanic rock.

Finally, when at the end of 100 to 300 years, it is considered that the time necessary for the first interim storage is ended, the final filling geochemical barrier is lowered into the core of the installation, whilst dismantling the ventilation system and blocking the gaps between the sources and the rock, together with all accesses such as tunnels, passages, etc. According to the invention, this filling must take place with a material which must:

ensure the thermal continuity between the radioactive sources and the rock after sealing, in order to permit the residual energy to continue to dissipate regularly until all activity finally ends, reestablish the mechanical continuity of the rock, reestablish the permeability of said rock, particularly with respect to percolating water, so that it is very close to its original characteristics, optionally act as a physicochemical barrier.

Various materials can be used for this filling operation and reference is made, in a nonlimitative manner;

to a mixture of crushed granite and clay of the bentonite type, in the case of granite rocks, in the case of salt or clay, these materials will themselves be used for filling purposes.

What is claimed is:

1. A geological installation for storing radioactive waste, said installation comprising;

a storage site located at a predetermined depth below ground level;

a plurality of vertical access shafts extending between the surface of the ground and the storage site for providing access for the waste and for ventilation purposes;

a first upper plurality of tunnels all lying in a first horizontal plane substantially equidistant from each other and parallel to a first reference line representative of the common direction of said first plurality of tunnels, the first reference line lying in the first horizontal plane and also lying in a first vertical plane;

means within said first plurality of tunnels for moving the waste;

a second lower plurality of tunnels all lying in a second horizontal plane substantially equidistant from each other and parallel to a second reference line representative of the common direction of said second plurality of tunnels, the second reference line lying in the second horizontal plane and also lying in a second vertical plane;

the first vertical plane of the first reference line representative of the common direction of said first plurality of tunnels intersecting the second vertical plane of the second reference line representative of the common direction of said second plurality of tunnels at an angle $\alpha$;

a plurality of vertical storage shafts for storing the waste and linking, in accordance with a regular geometric grid, the tunnels of the first plurality and the tunnels of the second plurality, the upper part of each storage shaft communicating with a tunnel of the first plurality and the lower part of each storage shaft communicating with a lateral recess connected to one of the tunnels of the second plurality; and at least one of said vertical access shafts supplying the tunnels of the second plurality with fresh air from the ground surface, and at least one other of said vertical access shafts evacuating hot air from the tunnels of the second plurality to the ground surface, the cooling air circulation taking place in hairpin-like manner in an upward-downward path in the vertical storage shafts connecting the two pluralities of tunnels during interim storage by the convective effect of heat released by the stored waste.

2. A geological installation according to claim 1, wherein the angle $\alpha$ of the direction of the tunnels of the second plurality with respect to the direction of the tunnels of the first plurality is equal to 30°, the regular geometrical grid of the vertical storage shafts between the two pluralities of tunnels being of a hexagonal grid type.

3. A geological installation according to claim 1, wherein the fresh air supply and the hot air discharge with respect to the tunnels of the second plurality takes place via a circle of two peripheral tunnels, which surround the tunnels of the second plurality and communicate therewith.

4. A geological installation according to claim 1, wherein within each vertical storage shaft, the radioactive waste is distributed into tubes occupying the periphery of the shaft and traversed by ascending fresh air, the hot air redescending into an empty central tube, whilst the base of each peripheral tube can have a drop damping device and the group of tubes rests on a concrete filled, cast iron base support, positioned in the centre of a lateral recess.

5. A geological installation according to claim 1, wherein the vertical storage shafts are sealed, at the point where they issue into the tunnels of the first plurality by a metal plate protecting personnel against radiation without preventing the movement of vehicles.

6. A geological installation according to claim 1, wherein the first upper plurality of tunnels is at between 300 and 1000 meters.

7. A geological installation according to claim 1, wherein the first upper plurality of tunnels and the second lower plurality of tunnels are vertically spaced by 20 to 40 meters and preferably 25 to 30 meters.

8. A geological installation according to claim 1, which is dug out of a rocky massif formed from rocks chosen in the group including granite, clay, salt and volcanic rock.

9. A geological installation according to claim 1, wherein the angle $\alpha$ of the direction of the tunnels of the second plurality with respect to the direction of the tunnels of the first plurality is equal to 45°, the regular geometrical grid of the vertical storage shafts between the two pluralities of tunnels being of a square grid type.

10. A geological installation for storing radioactive waste, said installation comprising;

a storage site located at a predetermined depth below ground level;

a plurality of vertical access shafts extending between the surface of the ground and the storage site for providing access for the waste and for ventilation purposes;

a first upper plurality of tunnels all lying in a first horizontal plane substantially equidistant from each other and parallel to a first reference line representative of the common direction of said first plurality of tunnels, the first reference line lying in the first horizontal plane and also lying in a first vertical plane;

means within said first plurality of tunnels for moving the waste;

a second lower plurality of tunnels all lying in a second horizontal plane substantially equidistant from each other and parallel to a second reference line representative of the common direction of said second plurality of tunnels, the second reference line lying in the second horizontal plane and also lying in a second vertical plane;

the first vertical plane of the first reference line representative of the common direction of said first plurality of tunnels intersecting the second vertical plane of the second reference line representative of the common direction of said second plurality of tunnels at an angle $\alpha$;

a plurality of vertical storage shafts for storing the waste and linking, in accordance with a regular geometric grid, the tunnels of the first plurality and the tunnels of the second plurality, the upper part of each storage shaft communicating with a tunnel of the first plurality and the lower part of each storage shaft communicating with a lateral recess connected to one of the tunnels of the second plurality; and at least one of said vertical access shafts supplying the tunnels of one of said pluralities with fresh air from the ground surface, and at least one other of said vertical access shafts evacuating hot air from the tunnels of the other of said pluralities to the ground surface, the cooling air circulation taking place in the vertical storage shafts connecting the two pluralities of tunnels during interim storage by the convective effect of heat released by the stored waste.

11. A geological installation according to claim 10, wherein the angle $\alpha$ of the direction of the tunnels of the second plurality with respect to the direction of the tunnels of the first plurality is equal to 30°, the regular geometrical grid of the vertical storage shafts between the two pluralities of tunnels being of hexagonal grid type.

12. A geological installation according to claim 10, wherein the angle $\alpha$ of the direction of the tunnels of the second plurality with respect to the direction of the tunnels of the first plurality is equal to 45°, the regular geometrical grid of the vertical storage shafts between the two pluralities of tunnels being of a square grid type.

* * * * *